US005318465A

United States Patent [19]

Boyle et al.

[11] Patent Number: 5,318,465

[45] Date of Patent: Jun. 7, 1994

[54] RETENTION SYSTEM WITH COLLAPSIBLE BRIDGE

[75] Inventors: Michael C. Boyle, Shelton; Anthony Canu, Waterbury, both of Conn.

[73] Assignee: Burndy Corporation, Norwalk, Conn.

[21] Appl. No.: 75,220

[22] Filed: Jun. 10, 1993

[51] Int. Cl.[5] ..... H01R 13/415

[52] U.S. Cl. ..... 439/741; 439/870

[58] Field of Search ..... 439/84, 560, 562, 741, 439/742, 870

[56] References Cited

U.S. PATENT DOCUMENTS

| | | | |
|---|---|---|---|
| 2,329,471 | 9/1943 | King | 85/2 |
| 2,848,768 | 8/1958 | Taylor | 439/870 X |
| 2,933,007 | 4/1960 | Healy | 85/2.4 |
| 3,613,043 | 10/1971 | Scheller et al. | 339/17 C |
| 3,812,447 | 5/1974 | Eifler et al. | 339/59 R |
| 4,359,258 | 11/1982 | Palecek et al. | 339/176 MP |
| 4,413,875 | 11/1983 | Mattingly | 339/217 R |
| 4,511,200 | 4/1985 | Belokin, Jr. | 339/50 R |
| 4,620,757 | 11/1986 | Thevenaz | 339/17 C |
| 4,762,498 | 8/1988 | Harting et al. | 439/82 |
| 4,941,847 | 7/1990 | Welsh | 439/595 |
| 5,035,656 | 7/1991 | Patel | 439/733 |
| 5,064,391 | 11/1991 | Buchter | 439/733 |
| 5,073,199 | 12/1991 | Soes | 439/82 |
| 5,147,227 | 9/1992 | Yurko | 439/733 |
| 5,147,228 | 9/1992 | Miller et al. | 439/741 |

*Primary Examiner*—Eugene F. Desmond
*Attorney, Agent, or Firm*—Perman & Green

[57] ABSTRACT

A system to connect and retain a first member with a second member. The first member has a mounting section with two arms and a bridge between the arms. The arms are canted towards each other in a general cantilever fashion and are deflectable outward from each other. The bridge extends between middle sections of the two arms and is deflectable as the arms are moved outward. The bridge can be collapsed to retain the arms in their outward position.

16 Claims, 2 Drawing Sheets

RETENTION SYSTEM WITH COLLAPSIBLE BRIDGE

BACKGROUND OF THE INVENTION

1. Field of the Invention

The present invention relates to retaining two members together and, in particular, to a system for connecting to members to each other by use of a collapsible bridge.

2. Prior Art

U.S. Pat. No. 2,329,471 discloses an electrical terminal with teeth that are driven into walls of a support as feet are bent. U.S. Pat. No. 2,933,007 discloses an insert member that has teeth. A screw expands sides of the insert and can contact a bottom cantilever. U.S. Pat. No. 5,147,227 discloses a terminal retention device with nibs. U.S. Pat. No. 5,073,119 discloses an electrical contact with a base section having compliant spring sections and projections.

SUMMARY OF THE INVENTION

In accordance with one embodiment of the present invention, a retention device is provided comprising two arms and a bridge extending between middle sections of the two arms. The two arms are canted towards each other in a general cantilever fashion and are reflectable outward from each other. The bridge is deflectable as the arms are moved outward from each other.

In accordance with another embodiment of the present invention, a retention device is provided comprising a first end, and a second end with a mounting section. The mounting section has arms connected by a bridge. The arms form an open top area therebetween, have bottom sections connected to the first end, and have barbs on their exterior. The bridge extends between middle sections of the arms and is permanently deformable to retain the arms at a predetermined position.

In accordance with another embodiment of the present invention, a retention system for connecting two members to each other, the system having a mounting section on a first one of the members for mounting the first member in a hole of a second one of the members is provided. The mounting section comprises deflectable arms adapted to be wedged apart and a bridge located between the arms. The arms have barbs at their exterior adapted to penetrate the second member when the arms are wedged apart. The bridge has a top section adapted to be contacted by a tool and a bottom stabilizer section. The bridge is deformable by the tool pressing on the top section to thereby retain the arms in a wedged apart position. The stabilizer section is adapted to prevent the bridge from twisting as the bridge is being deformed.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
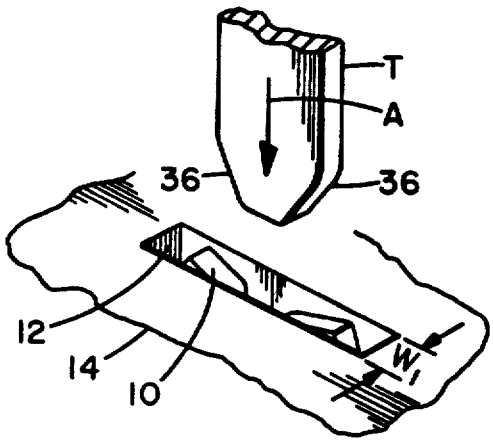
FIG. 1 is a perspective view of a retention device located in a hole of a second member and showing a tool adapted to deform the retention device into retention with the second member.

Referring to FIG. 1, there is shown a perspective view of the top of a retention device or first member 10 incorporating features of the present invention located in a hole 12 of a second member 14. Although the present invention will be described with reference to the embodiments shown in the drawings, it should be understood that the present invention can be embodied in various different forms of embodiments. The present invention can also be embodied into or with various different members or components, such as housings. In addition, the present invention can include any suitable size, shape or type of members of materials.

Figure 2:
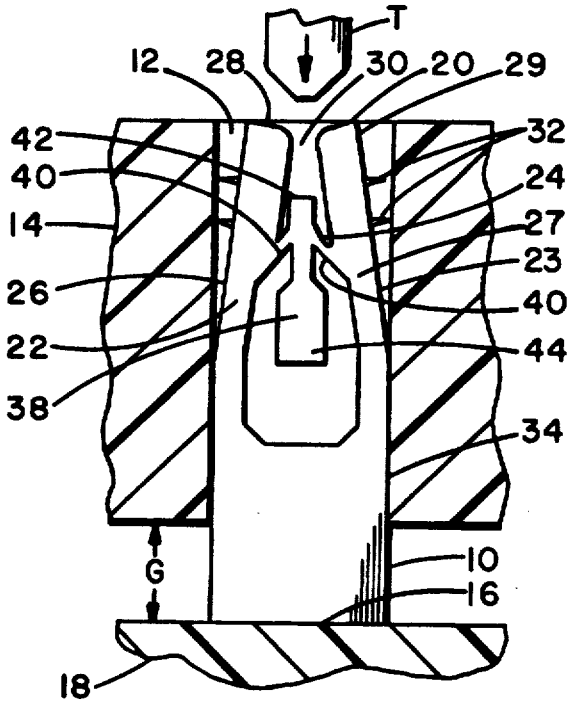
FIG. 2 is a schematic cross-sectional view of the embodiment shown in FIG. 1.

Referring also to FIG. 2, in the embodiment shown, the retention device 10 has a first end 16 fixedly connected to a third member 18 and a second end 20. Any suitable means could be used to connect the first end 16 to the third member 18. In an alternate embodiment, the retention device 10 could be integrally formed with the third member 18. The first end 16 could also be removably connected to the third member 18. In a preferred embodiment of use, the third member 18 is a molded polymer electrical connector and the second member 14 is a substrate of a printed circuit board. However, as noted above, the present invention can be used in any suitable environment or application.

The second end 20, in the embodiment shown, generally comprises two arms 22, 23 and a bridge 24 located between the two arms. The retention device 10 is preferably made as a one-piece member made of metal. It has a slight elongate length and a flat profile. However, any suitable length and profile could be provided. The bottom ends of the arms 22, 23 are connected to the first end 16 by a center section 34 and extend upward in a general cantilever fashion. The two arms 22, 23 are generally canted towards each other at their middle sections 26, 27 such that the tops 28, 29 of the arms are relatively close to each other with a gap 30 therebetween. Located on the exteriors of the arms 22, 23 are barbs 32. Due to the inward cant of the arms 22, 23, the barbs are located inward of the outer limits of center section 34 of the retention device 10. Therefore, retention device 10 is easily inserted into the hole 12 without interference from the barbs 32. In alternate embodiments, the retention device could have three or more arms and/or more or less than two barbs on each arm. In another alternate embodiment, the hole 12 could have a shape other than the straight slot shown, such as a shaped hole with receiving areas for receiving locators (not shown) on the arms that are larger than the barbs 32. The gap G between the bottom of the second member 18 is provided by standoffs (not shown) on the third member 18. However, the gap G need not be provided.

The bridge 24, in the embodiment shown, has a general "V" shape or upsidedown "V" shape with a center span 38 and two side spans 40. The two side spans 40 have first ends that are connected to the middle sections 26, 27 of the arms 22, 23, respectively, and second ends that are connected to opposite sides of the center span 38. The center span 38 includes a top contact section 42 and a bottom stabilizer section 44. The side spans 40 are angled convergently upward.

Figure 3:
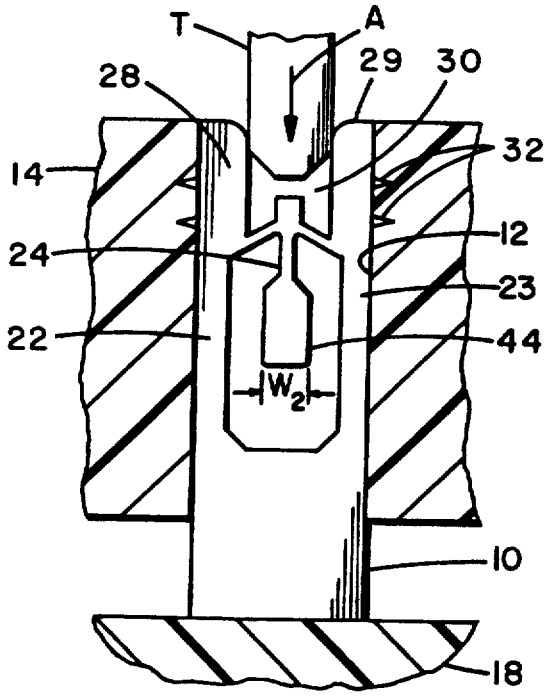
FIG. 3 is a schematic cross-sectional view as in FIG. 2 showing the arms of the retention device being spaced apart by the tool.
Figure 4:
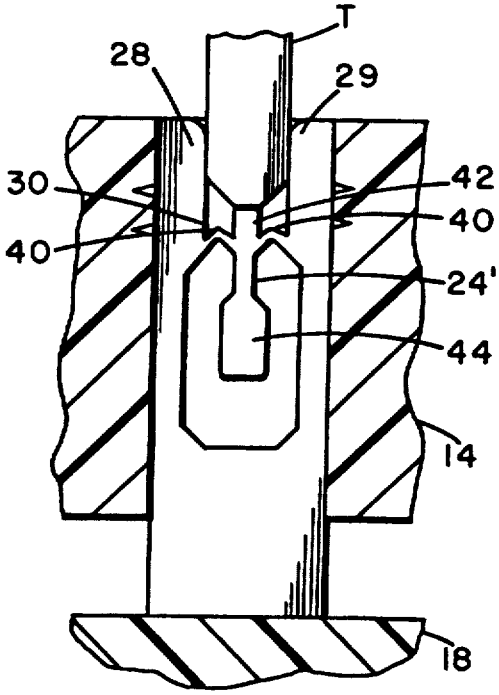
FIG. 4 is a schematic cross-sectional view as in FIG. 3 showing the bridge of the retention device being permanently deformed by the tool.

FIGS. 1 and 2 show the retention device 10 after it has been initially inserted into the hole 12, but prior to final connection. In order to obtain final connection of the retention device 10 to the second member 14, in the embodiment shown, a user uses the tool T. Referring to FIGS. 3 and 4, after the retention device 10 is positioned in hole 12, the user inserts the tool T downward, as indicated by arrow A, into the gap 30. In the embodiment shown, the front tip of the tool T has wedge ramps 36 to wedge apart the tops 28, 29 of the arms 22, 23 as the tool T is inserted. As the arms 22, 23 are wedged apart, the bridge 24 expands with the side spans 40 slightly straightening out. The exteriors of the arms 22, 23 spread out into contact with the interior walls of the hole 12. The barbs 32 penetrate the interior walls of the hole 12 to firmly grip the second member 14 as shown in FIG. 3. If the tool T was removed at this point, the spring characteristics of the arms 22, 23 and bridge 24 could cause the arms 22, 23 to move out of engagement with the second member 14. Therefore, the tool T is further inserted into the gap 30 as illustrated in FIG. 4.

The front of the tool T is used to contact and push on the top of the bridge's top contact section 42. Because the two side spans 40 are relatively thin, as the tool T pushes on the top contact section 42, the side spans 40 are able to be deformed or controllable collapse. As seen in FIG. 4, the side spans 40 controllable collapse such that the bridge 24 is transformed from its general upsidedown "V" shaped bridging configuration into a general "W" or upsidedown "W" shape. This deformation is permanent. Therefore, the tool T can now be removed and the collapsed bridge 24' will retain the arms 22, 23 at their wedged apart position connected to the second member 14. Since the side spans 40 are relatively thin, the bottom stabilizer section 44 is provided to prevent the bridge from twisting while being deformed. As seen in FIGS. 1 and 3, the stabilizer section 44 has a relatively wide width $W_2$, at least wider than the depth $W_1$ of the hole 12. Therefore, the stabilizer section 44 prevents the bridge from twisting inside the hole as it is being deformed. Hence, because the bridge is prevented from twisting, this insures the proper controlled collapse of the side spans 40.

Figure 5:
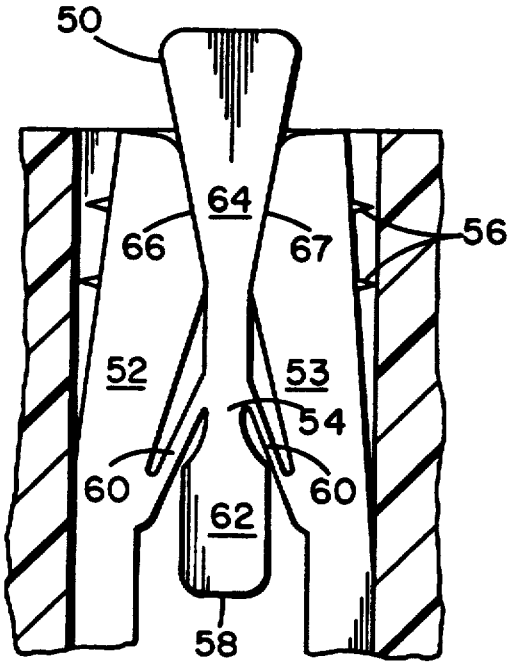
FIG. 5 is a partial schematic cross-sectional view of an alternate embodiment of the invention.
Figure 6:
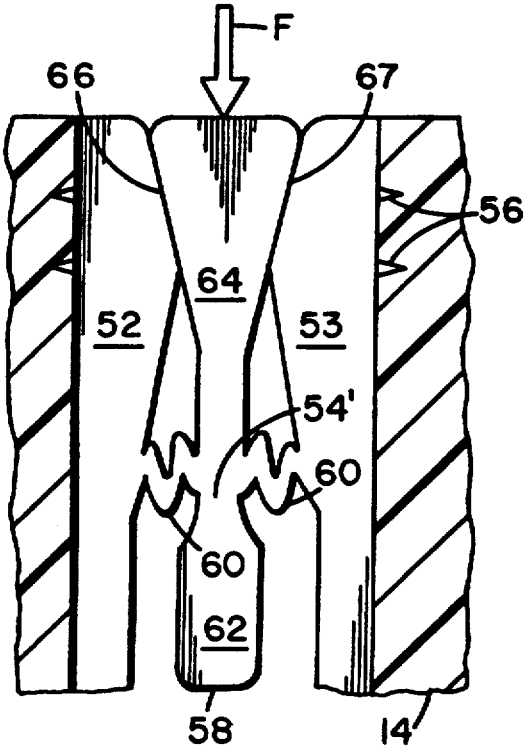
FIG. 6 is a view as in FIG. 5 showing the retention device permanently deformed.

Referring now to FIGS. 5 and 6, there is shown an alternate embodiment of the present invention. In the embodiment shown, the retention device 50 has two arms 52, 53 and a bridge 54. As shown prior to deformation in FIG. 5, the arms 52, 53 are canted towards each other with barbs 56. The bridge 54 has a center section 58 and two side spans 60. The center section 58 includes a bottom stabilizer section 62 and a top built-in wedge section 64. The wedge section 64 has wedge shaped sides 66, 67 that contact the interior sides of the arms 52, 53. The outer ends of the side spans 60 are connected to the arms 52, 53 at the beginning of their cant towards each other.

As shown in FIG. 6, the connection of the retention device 50 to the member 14 merely requires applying a force F to the top of the wedge section 64. The wedge shaped sides 66, 67 push apart the arms 52, 53 and drive the barbs 56 into the member 14. The side spans 60 of the bridge 54 are deformed. The stabilizer section 62 keeps the bottom of the center section 58 from twisting during deformation. The deformed bridge 54', unlike the deformed bridge 24' in FIG. 4, does not directly keep the arms 52, 53 apart. Rather, the deformed bridge 54' keeps the wedge section 64 in its downward wedging position shown in FIG. 6. It is the wedge section 64 that directly keeps the arms 52, 53 wedged apart. Alternative or additional means to keep the wedge section 64 locked in position could be provided. Thus, in the embodiment shown in FIGS. 5 and 6, no special tool need be used.

Figure 7:
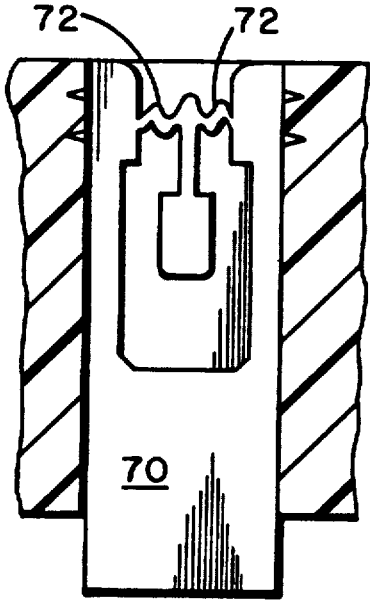
FIG. 7 is a schematic cross-sectional view of an alternate embodiment of the present invention.
Figure 8:
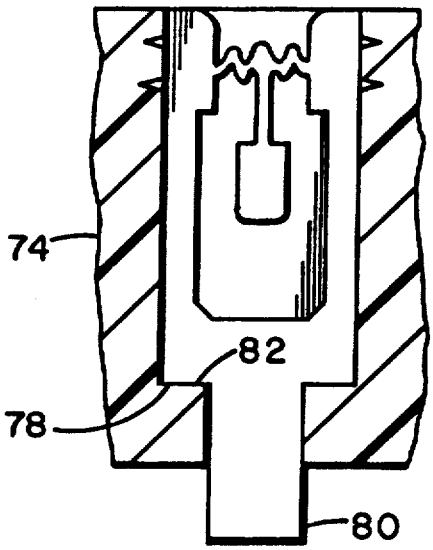
FIG. 8 is a schematic cross-sectional view of an alternate embodiment of the present invention.

Referring to FIGS. 7 and 8, alternate embodiments are shown. The retention device 70 in FIG. 7 has longer side spans 72 that, when deformed, form a zig-zag shape. FIG. 8 shows a housing member 74 with a shelf 78 and a retention device 80 with a shelf 82. This type of embodiment allows the retention device 80 to be precisely located relative to the housing member 74. In alternate embodiments, any suitable type of means for precisely locating the retention device in a hole of a member could be provided.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A retention device comprising:

two arms canted towards each other in a general cantilever fashion and being deflectable outward from each other; and a bridge extending between middle portions of the two arms, the bridge being deflectable as the arms are moved outward from each other.

2. A device as in claim 1 wherein the arms include barbs on their exterior.

3. A device as in claim 1 wherein the bridge is adapted to be expanded and collapsed to permanently deform the bridge and retain the arms at a mounted position.

4. A device as in claim 3 wherein the bridge includes a top contact section adapted to be contacted by a tool and pushed on to expand and collapse the bridge.

5. A device as in claim 3 wherein the bridge includes a bottom stabilizer section adapted to prevent the bridge from twisting as the arms are moved outward.

6. A device as in claim 4 wherein the top contact section includes built-in wedge section adapted to wedge the arms apart.

7. A device as in claim 1 wherein the mounting section is comprised of a single piece of sheet metal.

8. A retention device comprising:

a first end; and a second end with a mounting section, the mounting section having arms connected by a bridge, the arms forming an open top area therebetween, having bottom sections connected to the first end, the arms having barbs on their exterior, and the bridge extending between middle sections of the arms and being permanently deformable to retain the arms at a predetermined position.

9. A device as in claim 8 wherein the bridge has a general "V" shaped bridging section that is adapted to be collapsed into a general "W" shape.

10. A device as in claim 8 wherein the bridge has a stabilizer section to prevent a bridging section from twisting.

11. A device as in claim 8 wherein the bridge includes a built-in wedge section.

12. A device as in claim 8 wherein top sections and the middle sections of the arms are canted towards each other.

13. A device as in claim 8 wherein the mounting section is comprised of a single piece of sheet metal.

14. A retention system for connecting two members to each other, the system having a mounting section on a first one of the members for mounting the first member in a hole of a second one of the members, the mounting section comprising:

deflectable arms adapted to be wedged apart, the arms having barbs at their exterior adapted to penetrate the second member when the arms are wedged apart; and a bridge located between the arms having a top section adapted to be contacted by a tool and a bottom stabilizer section, the bridge being deformable by the tool pressing on the top section to thereby retain the arms in a wedged apart position and the stabilizer section being preventing the bridge from twisting as the bridge is being deformed.

15. A system as in claim 14 wherein the top section of the bridge has a built-in wedge section.

16. A system as in claim 14 wherein the bridge has a bridging section with a general "V" shape that is adapted to be expanded and collapsed into a general "W" shape.

* * * * *